United States Patent [19]

Ryer et al.

[11] 4,396,518

[45] Aug. 2, 1983

[54] DEMULSIFIER COMPOSITION FOR AUTOMATIC TRANSMISSION FLUIDS

[75] Inventors: Jack Ryer, East Brunswick; Harold E. Deen, Cranford, both of N.J.

[73] Assignee: Exxon Research & Engineering Co., Florham Park, N.J.

[21] Appl. No.: 314,744

[22] Filed: Oct. 26, 1981

[51] Int. Cl.[3] ..... C10M 1/20

[52] U.S. Cl. ..... 252/52 R; 252/79

[58] Field of Search ..... 252/52 R, 79 R

[56] References Cited

U.S. PATENT DOCUMENTS

| | | | |
|---|---|---|---|
| 3,920,562 | 11/1975 | Foehr | 252/32.7 E |
| 3,974,081 | 8/1976 | Rutkowski et al. | 252/79 |
| 4,264,460 | 4/1981 | Gutierrez et al. | 252/48.6 |

*Primary Examiner*—W. J. Shine

*Attorney, Agent, or Firm*—J. J. Mahon

[57] ABSTRACT

There is disclosed an automatic transmission fluid containing an improved demulsifier additive being a combination of an acylated alkoxylated isopentylphenolic resin and a propoxylated-ethoxylated amylphenolic resin, the additive being effective at concentrations of 30 to 50 ppm.

4 Claims, No Drawings

DEMULSIFIER COMPOSITION FOR AUTOMATIC TRANSMISSION FLUIDS

This invention relates to an improved additive for use as one component of an automatic transmission fluid (ATF). More particularly this invention relates to an improved demulsifier which has been found effective at treatment levels relatively lower than those heretofore used for such additives in ATF compositions.

ATF compositions are complex formulations containing a number of additives each of which serves a specific purpose. Reference may be made to U.S. Pat. No. 3,974,081 issued Aug. 10, 1976 to Rutkowski et al, U.S. Pat. No. 3,920,562 issued Nov. 18, 1975 to Foehr and U.S. Pat. No. 4,264,460 issued Apr. 28, 1981 to Gutierrez et al which contain descriptions of these ATF compositions.

An important component of such ATF formulations is the demulsifier additive. For a fluid to qualify for approval of General Motors Corporation, it must satisfy the specification details for Dextron® II fluids which are detailed in General Motors Engineering Standard Specification GM 6137-M July 1978. One requirement is a satisfactory demulsibility performance so that the ATF composition does not form a stable emulsion should it come into contact with a quantity of water.

The present invention is based upon the discovery that a mixture of two specific modified oil-soluble phenolic resins, when combined in certain amounts, provide a synergistic effect in demulsibility performance.

In accordance with the present invention there is provided an ATF composition containing two component demulsifier additive composition effective at levels of 30 to 50 ppm (parts per million parts by weight) based upon the weight of the finished automatic transmission fluid composition, the demulsifier additive composition consisting essentially of a combination of:

(a) 50 to 75 weight percent of a 35–50 weight percent solution in aromatic solvent of an oil-soluble isopentylphenol-formaldehyde resin having a degree of polymerization of 5 to 10, the resin being alkoxylated with 1 to 5 moles of ethylene oxide or propylene oxide and acylated by reaction of the free OH groups with a stoichiometric amount of acetic or propionic acid; and (b) 50 to 25 weight percent of a 40 to 50 weight percent solution in aromatic solvent of an amylphenol-formaldehyde resin having a degree of polymerization of 5–10, which has been alkoxylated with a mixture of propylene oxide and ethylene oxide, propylene oxide comprising 60 to 70 weight percent of the mixture the weight ratio of resin to said mixture being about 1 to 2.5.

Both the (a) and (b) components noted above of the composition of the present invention are materials known in the art to have demulsification properties. The (a) component, based on isopentylphenol, is a commercial product available as a 39 weight percent solution and sold as "Tretolite GWH 322" by Petrolite Corporation and the (b) component based on amylphenol is available as a 45 weight percent solution and sold under the designation "Breaxit 7937" by Exxon Chemical Americas.

Suitable aromatic solvents are benzene and lower alkyl ($C_1$–$C_4$) benzenes, such as toluene and xylene, the latter two being preferred since the resins are commercially available in these solvents.

To pass the demulsibility test, an ATF composition would require 100 ppm of the (a) component, if used alone, but 50 ppm of this component will not pass the test. Similarly, the (b) component at 100 ppm will not satisfy the requirement of the test. It has been found, however, that using a combination of 50–75 weight percent of the (a) component with 50–25 weight percent of the (b) component produces passing values at treatment levels of 30 to 50 ppm. These results therefore indicate a synergistic effect upon combination of these materials by simple admixture and the invention offers the advantage of reducing the quantity of additive required to formulate a commercially successful ATF composition which passes the relevant test for demulsification.

ATF systems are compounded from a number of additives each useful for improving a chemical and/or physical property of the ATF. The additives are usually sold as a package in which mineral oil is present. The mineral lubricating oil will constitute from 40 to 60 weight percent of the package and is a refined hydrocarbon oil or a mixture of refined hydrocarbon oils selected according to the viscosity requirements of the particular ATF but typically would have a viscosity range of 75–150 SSU at 37.8° C. Additives present in such packages include viscosity improvers, corrosion inhibitors, oxidation inhibitors, friction modifiers, dispersants, demulsifiers, anti-foaming agents, anti-wear agents, pour point depressants and seal swellants.

The viscosity improvers that may be employed in ATF include any of the types known to the art including polyisobutylene, copolymers of ethylene and propylene, polymethacrylates, methacrylate copolymers, copolymers of an unsaturated dicarboxylic acid and a vinyl compound and interpolymers of styrene and acrylic esters.

Corrosion inhibitors also known as anti-corrosive agents reduce the degradation of the metallic parts contained by the ATF. Illustrative of corrosion inhibitors is zinc dialkyldithiophosphate, phosphosulfurized hydrocarbons and the products obtained by reaction of a phosphosulfurized hydrocarbon with an alkaline earth metal oxide or hydroxide, preferably in the presence of an alkylated phenol or of an alkylphenol thioether, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 weight percent of a sulfide of phosphorus for ½ to 15 hours, at a temperature in the range of 150° to 600° F. Neutralization of the phosphosulfurized hydrocarbon may be effected in the manner taught in U.S. Pat. No. 2,969,324.

Oxidation inhibitors reduce the tendency of mineral oils to deteriorate in service which deterioration is evidenced by the products of oxidation such as sludge and varnish-like deposits on the metal surfaces. Such oxidation inhibitors include alkaline earth metal salts of alkylphenol thioethers having preferably $C_5$ to $C_{12}$ alkyl side chains, e.g. calcium nonylphenol sulfide, barium t-octylphenol sulfide, zinc dialkyldithiophosphates, dioctylphenylamine, phenylalphanaphthylamine, phosphosulfurized or sulfurized hydrocarbons, etc.

Dispersants maintain oil insolubles resulting from oxidation during use in suspension in ATF thus preventing sludge flocculation and precipitation. Suitable dispersants include high molecular weight alkylsuccinates, the reaction product of oil-soluble polyisobutylene succinic anhydride with ethylene amines such as tetraethylene pentamine and borated salts thereof.

Pour point depressants lower the temperature at which the ATF will flow or can be poured. Such depressants are well known. Typical of those additives which usefully optimize the low temperature fluidity of the ATF of the invention are $C_8$–$C_{18}$ dialkylfumarate vinyl acetate copolymers, polymethacrylates, and wax naphthalene condensation products.

Foam control is provided by an anti-foamant of the polysiloxane type, e.g. silicone oil and polydimethyl siloxane.

Anti-wear agents as their name implies reduce wear of the transmission parts. Representative of suitable anti-wear agents are zinc dialkyldithiophosphate, zinc diaryldithiophosphate and magnesium sulfonate.

Some of these numerous additives can provide a multiplicity of effects, e.g., a dispersant-oxidation inhibitor. This approach is well known and need not be further elaborated herein.

Seal swellants which are present in combination with the friction modifier of the invention include mineral oils of the type that provoke swelling and aliphatic alcohols of 8 to 13 carbon atoms such as tridecyl alcohol with a preferred seal swellant being characterized as an oil-soluble, saturated, aliphatic or aromatic hydrocarbon ester of from 10 to 60 carbon atoms and 2 to 4 ester linkages, e.g., dihexylphthalate, as are described in U.S. Pat. No. 3,974,081.

ATF compositions contain these conventional additives and are typically blended into the mineral oil base in the following ranges thereby providing their normal attendant functions.

| Components | Concentration Range (Vol. %) |
|---|---|
| V.I. Improver | 1–15 |
| Corrosion Inhibitor | 0.01–1 |
| Oxidation Inhibitor | 0.01–1 |
| Dispersant | 0.5–10 |
| Pour Point Depressant | 0.01–1 |
| Demulsifier | 0.001–0.1 |
| Anti-Foaming Agents | 0.001–0.1 |
| Anti-Wear Agents | 0.001–1 |
| Seal Swellant | 0.1–5 |
| Friction Modifiers | 0.01–1 |
| Mineral Oil Base | Balance |

The invention is further illustrated by the following Examples which are not to be considered as limitative of its scope.

EXAMPLES

Testing for demulsibility is carried out by adding 20 cc of water to 200 cc of an ATF composition and blending the mixture at high temperature (80° F.) with high speed mixing to emulsify the water into the ATF. The samples are then placed in calibrated graduated cylinders and the degree of separation of water, quantity of cuff or interface formed and clarity of the oil layer are observed. Passing results are indicated by an absence of an insignificant amount of "cuff" or interfacial portion, a clear or cloudy oil, and the important observation being a separation of 8.5 cc or more of water from the oleaginous phase. The (a) and (b) components of the present invention were tested in varying relative preparations at the 50 ppm level in a fully formulated ATF composition which contained 4.4 volume percent of dispersant, 9 volume percent viscosity modifier, 0.4 volume percent friction modifier, 0.2 volume percent anti-wear additive, and very small proportions of corrosion and oxidation inhibitors, seal swellants and pour depressant. The (a) and (b) components were used, respectively, as 39 weight percent and 45 weight percent solution in aromatic solvent (toluene or xylene) with the results tabulated below. Percentages are by weight.

| DEMULSIBILITY RESULTS MIXED DEMULSIFIER: % (a)/% (b) | | | | | |
|---|---|---|---|---|---|
| | 75/25 | 75/25 | 0/100 | 100/0 | 50/50 |
| $H_2O$ Separation, cc. | 9.4 | 9.0 | 3.5 | 8.0 | 8.9 |
| Cuff, cc. | 0 | 0 | 11 | 0.5 | 0 |
| Oil Appearance | Cloudy | Cloudy | V. Cloudy | Cloudy | Cloudy |

Also, combinations of (a) and (b) composed of less than 50 weight percent of (a) provided unsatisfactory results. These data show the synergistic effect of the two component ATF demulsifier composition of this invention.

What is claimed is:

1. An automatic transmission fluid comprising a formulated automatic transmission fluid containing a demulsifier additive, said additive providing effective demulsification at concentrations of 30 to 50 parts per million, the demulsifier consisting essentially of two components:

(a) 50 to 75 weight percent of a solution in aromatic hydrocarbon solvent of an oil soluble isopentylphenol-formaldehyde resin having a degree of polymerization of 5–10, the resin being alkoxylated with 1 to 5 moles of ethylene oxide or propylene oxide and acylated by reaction with acetic acid or propionic acid, the solution having a concentration of 35 to 50 weight percent of said resin; and (b) 50 to 25 weight percent of a 40 to 50 weight percent solution in aromatic hydrocarbon solvent of an oil soluble amylphenolformaldehyde resin having a degree of polymerization of 5–10 which has been alkoxylated with a propylene oxide-ethylene oxide mixture, the mixture containing 60–70 weight percent of propylene oxide, the weight ratio of resin to said mixture being 1 to 2.5.

2. The composition of claim 1 where the two component additive consists of 75 weight percent of said (a) component and 25 weight percent of said (b) component.

3. The composition of claim 2 where the aromatic solvent for said (a) component and (b) component is toluene or xylene.

4. The composition of claim 3 where the concentration of said (a) component in said solvent is about 39 weight percent and the concentration in said solvent of said (b) component is about 45 weight percent.

* * * * *